US010571089B2

(12) United States Patent
Matsunaga

(10) Patent No.: US 10,571,089 B2
(45) Date of Patent: Feb. 25, 2020

(54) POWER SUPPLY ATTACHMENT AND AUTOMOTIVE LAMP

(71) Applicant: KOITO MANUFACTURING CO., LTD., Tokyo (JP)

(72) Inventor: Takashi Matsunaga, Shizuoka (JP)

(73) Assignee: KOITO MANUFACTURING CO., LTD., Minato-Ku, Tokyo (JP)

( * ) Notice: Subject to any disclaimer, the term of this patent is extended or adjusted under 35 U.S.C. 154(b) by 0 days.

(21) Appl. No.: 16/163,405

(22) Filed: Oct. 17, 2018

(65) Prior Publication Data

US 2019/0049084 A1 Feb. 14, 2019

Related U.S. Application Data

(63) Continuation of application No. PCT/JP2017/014176, filed on Apr. 5, 2017.

(30) Foreign Application Priority Data

Apr. 18, 2016 (JP) ..... 2016-082816

(51) Int. Cl.
*F21S 41/19* (2018.01)
*H01R 13/24* (2006.01)
*F21S 41/148* (2018.01)

(52) U.S. Cl.
CPC ..... *F21S 41/192* (2018.01); *H01R 13/2442* (2013.01); *F21S 41/148* (2018.01)

(58) Field of Classification Search
CPC ..... F21S 41/147; F21S 41/192; F21S 41/148; F21Y 2115/10
See application file for complete search history.

(56) References Cited

U.S. PATENT DOCUMENTS

2006/0239021 A1 10/2006 Inaba
2007/0171667 A1* 7/2007 Watanabe ..... F21V 19/0015 362/545

(Continued)

FOREIGN PATENT DOCUMENTS

JP 2008-270106 11/2008
JP 2008-305718 12/2008

(Continued)

OTHER PUBLICATIONS

International Search Report on corresponding PCT Application No. PCT/JP2017/014176, dated Jun. 27, 2017.

(Continued)

*Primary Examiner* — Alexander K Garlen
*Assistant Examiner* — Eric T Eide
(74) *Attorney, Agent, or Firm* — Buchanan Ingersoll & Rooney PC

(57) ABSTRACT

A power supply attachment provides electrical connection to a light source and fixes the light source to a light source placement portion on a placement member. The power supply attachment is provided with: an attachment main body, which is provided with an attachment bottom surface that comes into contact with the placement member and which has an attachment opening for receiving the light source placement portion; a power supply terminal, which extends from the attachment main body to the attachment opening; and a first rib, which extends from the attachment main body to the attachment opening. The first rib is provided with a first rib bottom surface that becomes closer to the attachment bottom surface than the power supply terminal.

8 Claims, 7 Drawing Sheets

(56) References Cited

U.S. PATENT DOCUMENTS

| | | | | |
|---|---|---|---|---|
| 2007/0177401 | A1* | 8/2007 | Nakabayashi | F21S 41/147<br>362/548 |
| 2012/0287658 | A1* | 11/2012 | Tanaka | F21S 41/192<br>362/516 |
| 2012/0314436 | A1* | 12/2012 | Inoue | F21V 29/763<br>362/487 |
| 2013/0051053 | A1* | 2/2013 | Yasuda | B60Q 1/076<br>362/516 |
| 2013/0201706 | A1* | 8/2013 | Suzuki | F21V 29/677<br>362/487 |
| 2013/0341670 | A1* | 12/2013 | Matsunaga | H01L 33/644<br>257/99 |

FOREIGN PATENT DOCUMENTS

| | | |
|---|---|---|
| JP | 2014-197550 | 10/2014 |
| WO | 2012/120979 | 9/2012 |

OTHER PUBLICATIONS

International Preliminary Report on Patentability on corresponding PCT Application No. PCT/JP2017/014176, dated Oct. 23, 2018.

Extended European Search Report dated Dec. 20, 2019 in corresponding European Patent Application No. 17785791.9-1012 (9 pages).

* cited by examiner

POWER SUPPLY ATTACHMENT AND AUTOMOTIVE LAMP

CROSS-REFERENCE TO RELATED APPLICATIONS

This application claims priority of JP application 2016-082816 which was filed on 18 Apr. 2016 and WO application PCT/JP2017/014176 which was filed on 5 Apr. 2017 and which are incorporated herein in its entirety by reference.

FIELD

The present invention relates to power supply attachments and automotive lamps.

BACKGROUND

Light source modules provided with: a circuit board on which a semiconductor light emitting element is mounted and which is placed on a placement base of a light source holding member; and a power supply attachment that supplies electric power to the semiconductor light emitting element. The power supply attachment is attached to the light source holding member such that at least a part of the circuit board is pressed against the placement base (see, for example, International Publication No. 2012/120979).

SUMMARY

A power supply attachment according to one embodiment of the present invention is a power supply attachment for providing electrical connection to a light source and fixing the light source to a light source placement portion on a placement member, comprising: an attachment main body that is provided with an attachment bottom surface that comes into contact with the placement member, and has an attachment opening for receiving the light source placement portion; a power supply terminal that extends from the attachment main body to the attachment opening; and a first rib that extends from the attachment main body to the attachment opening. The first rib is provided with a first rib bottom surface that becomes closer to the attachment bottom surface than the power supply terminal.

Another embodiment of the present invention relates to an automotive lamp. This automotive lamp comprises: a light source; a placement member that is provided with a light source placement portion on which the light source is placed; and a power supply attachment according to the above embodiment for providing electrical connection to the light source and fixing the light source to the light source placement portion.

BRIEF DESCRIPTION OF THE DRAWINGS

Embodiments will now be described, by way of example only, with reference to the accompanying schematic drawings, in which.

DETAILED DESCRIPTION

Figure 1:
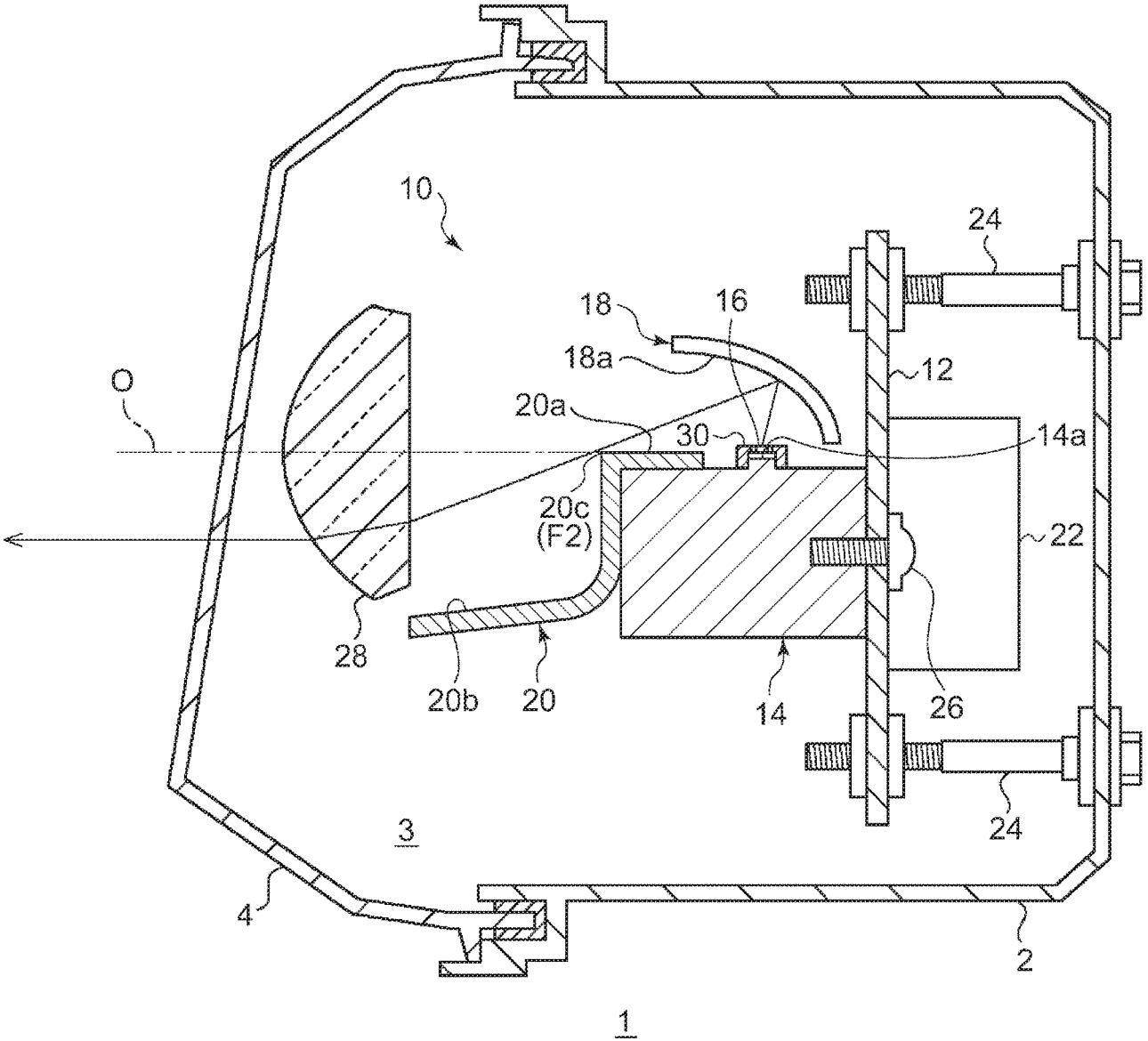
FIG. 1 is a vertical cross-sectional view schematically showing a schematic structure of an automotive lamp according to a first embodiment in which a lamp unit is mounted.

A description will be given of the present invention with reference to the drawings based on preferred embodiments. The embodiments do not limit the invention and are shown for illustrative purposes, and all the features described in the embodiments and combinations thereof are not necessarily essential to the invention. The same or equivalent constituting elements, members, and processes illustrated in each drawing shall be denoted by the same or equivalent reference numerals, and duplicative explanations will be omitted appropriately. Further, the scales and shapes of parts shown in each drawing are set for the sake of convenience in order to facilitate the explanation and are not to be interpreted in a limited manner unless otherwise mentioned.

In an assembly process, a circuit board may be placed somewhat off a specified location by mistake. If the displacement from the specified location is not that large, it may be possible to assemble a power supply attachment on the misplaced circuit board. In that case, the circuit board and the power supply attachment may interfere, causing undesired deformation in one or both of them. For example, a power supply terminal of the power supply attachment may be deformed.

In this background, a purpose of the present invention is to provide a power supply attachment useful for accurate assembly and an automotive lamp provided with the power supply attachment.

(First Embodiment)

FIG. 1 is a vertical cross-sectional view schematically showing a schematic structure of an automotive lamp according to a first embodiment in which a lamp unit is mounted. An automotive lamp 1 explained in the present embodiment is an automotive headlamp apparatus that has a pair of headlamp units disposed on the left and right of the front of a vehicle. Since the pair of head lamp units have substantially the same structure, FIG. 1 shows, as the automotive lamp 1, the structure of a headlamp unit that is disposed on either the left or the right.

As shown in FIG. 1, the automotive lamp 1 is provided with a lamp body 2 having an opening toward the front side of the vehicle and a light-transmitting cover 4 attached to cover the opening of the lamp body 2. The light-transmitting cover 4 is formed of a resin, glass, or the like that transmits light. A lamp unit 10 is housed in a lamp chamber 3 formed of the lamp body 2 and the light-transmitting cover 4.

The lamp unit 10 is a so-called projector-type lamp unit and is provided with a bracket part 12, a placement member 14, a light source module (hereinafter, also simply referred to as "light source") 16, a reflector 18, a shade part 20, a projection lens 28, and a power supply attachment 30.

The bracket part 12 is, for example, a substantially plate-shaped member formed of a metal material such as aluminum, and the main surface thereof is disposed to face the front/back direction of the lamp. On the main surface of the bracket part 12 toward the front side of the lamp, the placement member 14 is fixed. On the main surface of the bracket part 12 toward the back side of the lamp, a heat radiation fin 22 is fixed. The bracket part 12 has thread holes at predetermined positions on the edge portion. Aiming screws 24 extending forward through the lamp body 2 are threadably engaged with the thread holes. This allows the bracket part 12 to be attached to the lamp body 2. The automotive lamp 1 is formed such that an optical axis O of the lamp unit 10 can be adjusted horizontally or vertically using the aiming screws 24. The shape of the bracket part 12 is not particularly limited to this.

The placement member 14 is formed of, for example, a metal material such as aluminum, and projects toward the front side of the lamp from the main surface of the bracket part 12 facing toward the front side of the lamp. The placement member 14 has a light source placement portion 14*a* facing upward in a direction perpendicular to the optical axis O of the lamp unit 10. On the light source placement portion 14*a*, the light source 16 is placed. The placement member 14 is fixed to the bracket part 12 by a fastening member 26 such as a screw that penetrates the bracket part 12 from the rear side of the bracket part 12 and projects into the placement member 14. The placement member 14 may be a member integrally formed with the heat radiation fin 22, and in that case, the member can be referred to as a heat sink.

As will be described in detail later, the power supply attachment 30 is provided in order to provide electrical connection to the light source 16 and to fix the light source 16 to the light source placement portion 14*a*. Electric power is supplied to the light source 16 via the power supply attachment 30 from a control circuit (not shown) of the light source 16. Further, the power supply attachment 30 is attached to the placement member 14, and the light source 16 is sandwiched between the power supply attachment 30 and the light source placement portion 14*a*.

The light source 16 is disposed such that a light emitting surface thereof faces substantially upward in a direction perpendicular to the optical axis O. The light source 16 is, for example, a light emitting diode (LED). The light source used for the lamp unit 10 may be an incandescent bulb, a halogen lamp, a discharge bulb, or the like. The heat generated from the light source 16 is transmitted to the heat radiation fin 22 via the placement member 14 and the bracket part 12.

The reflector 18 has a substantially dome shape and is disposed above the light source 16 and fixed to the placement member 14. The reflector 18 has a reflecting surface 18*a* formed with a free-form surface based on a spheroidal surface in the inside of the reflector 18. This reflecting surface 18*a* has a first focal point and a second focal point located more toward the front side of the lamp than the first focal point. In the reflector 18, the positional relationship with the light source 16 is determined such that a light emitting unit of the light source 16 substantially coincides with the first focal point of the reflecting surface 18*a*.

On the side of the placement member 14 facing toward the front of the lamp, the shade part 20 is provided. The shade part 20 is fixed to the placement member 14 by a fastening member such as a screw. The shade part 20 is a plate-shaped resin member and has a flat portion 20*a* disposed substantially horizontally and a curved portion 20*b* curving downward at a position more toward the front of the lamp than the flat portion 20*a* so as not to block source light entering the projection lens 28. In the reflector 18, the positional relationship with the shade part 20 is determined such that an edge line 20*c* formed by the flat portion 20*a* and the curved portion 20*b* of the shade part 20 is located near the second focal point of the reflecting surface 18*a*.

The shade part 20 can also function as a lens holder. A fixing portion (not shown) of the projection lens 28 may be fixed to the distal end of the curved portion 20*b* of the shade part 20. The front side surface of the projection lens 28 is a convex surface and is a light transmitting member that projects light from the light source 16 mounted on the placement member 14 toward the front of the lamp. The projection lens 28 projects, as an inverted image, a light source image formed on a rear focal plane including a rear focal point of the projection lens 28 onto a virtual vertical screen in front of the lamp. The projection lens 28 is disposed on the optical axis O of the lamp unit 10 and at a position where the rear focal point substantially coincides with the second focal point of the reflecting surface 18*a* of the reflector 18.

Light emitted from a light emitting element 16*a* of the light source 16 is reflected by the reflecting surface 18*a* of the reflector 18 and enters the projection lens 28 through the second focal point of the reflecting surface 18*a*, that is, the vicinity of the edge line 20*c*. The light that has entered the projection lens 28 is radiated from the projection lens 28 toward the front of the lamp as approximately parallel light. Further, a part of the source light is reflected on the flat portion 20*a* of the shade part 20, and the source light is thereby selectively cut using the edge line 20*c* as a boundary line. As a result, a light distribution pattern having a cutoff line corresponding to the shape of the edge line 20*c* is projected toward the front of the vehicle.

Figure 2:
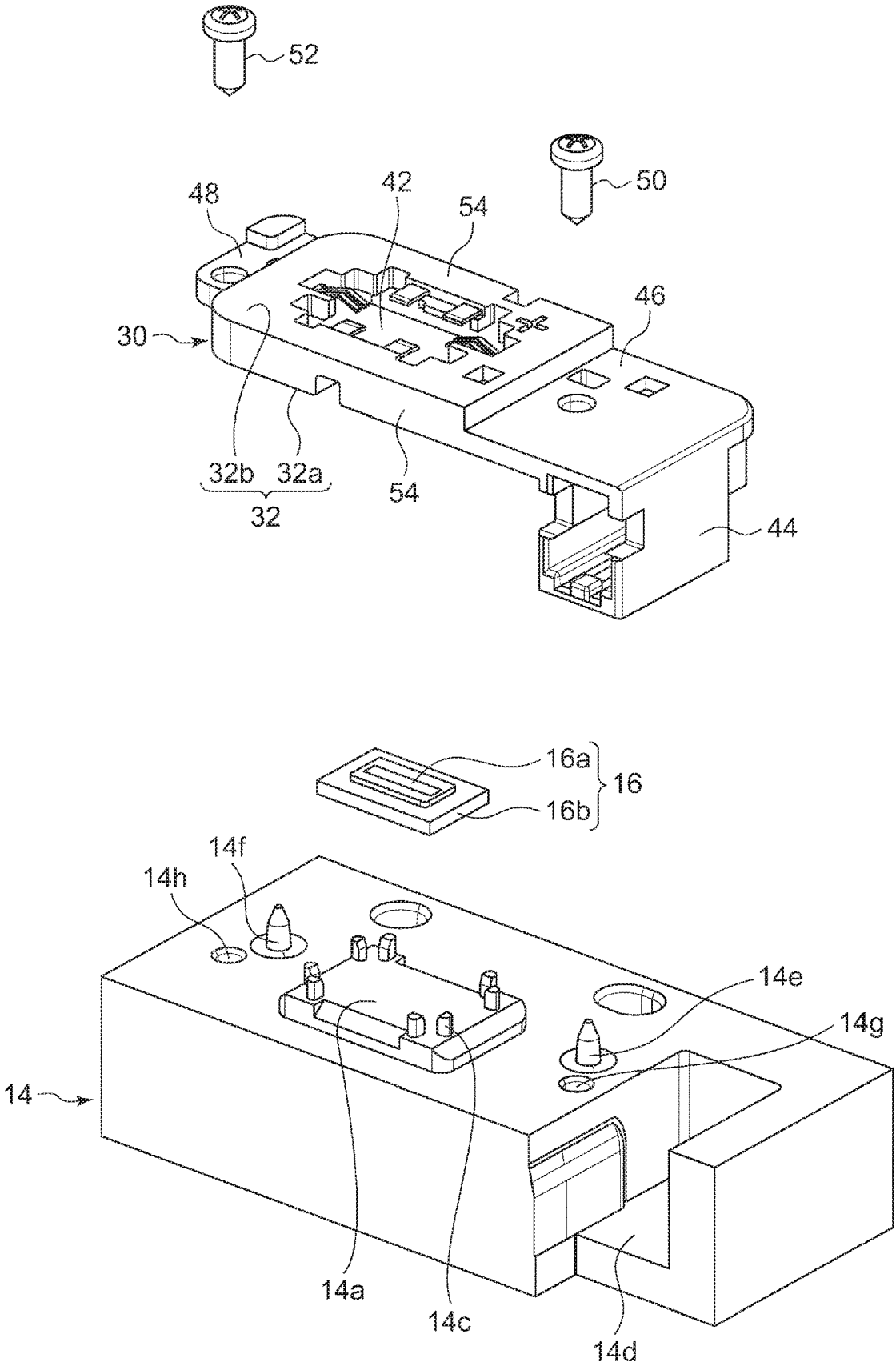
FIG. 2 is a schematic exploded perspective view of a light source and the peripheral structure of the light source shown in FIG. 1.
Figure 3:
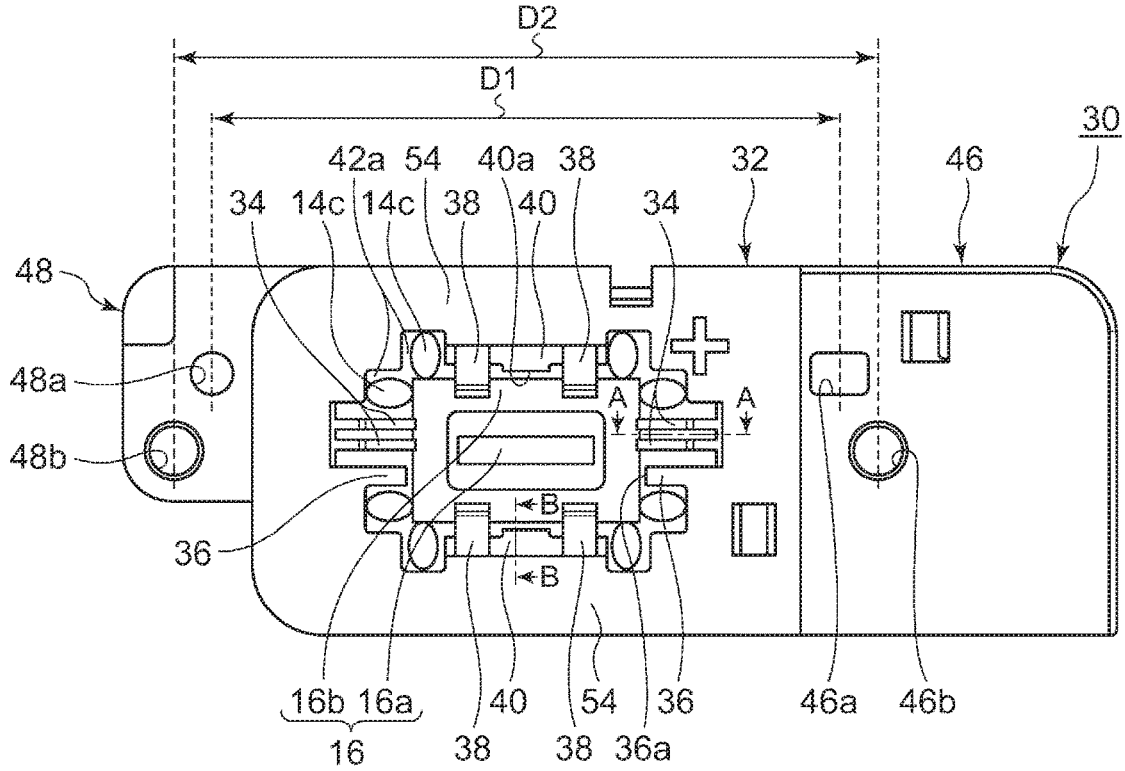
FIG. 3 is a schematic top view of the light source and the peripheral structure of the light source shown in FIG. 1.

FIG. 2 is a schematic exploded perspective view of the light source 16 and the peripheral structure of the light source 16 shown in FIG. 1. FIG. 3 is a schematic top view of the light source 16 and the peripheral structure of the light source 16 shown in FIG. 1.

The light source 16 has a light emitting element 16*a* and a substrate 16*b*, which supports the light emitting element 16*a*. On the substrate 16*b*, an electrode and wiring for supplying electric power to the light emitting element 16*a* that is mounted are provided. In the electrode and wiring of the substrate 16*b*, there are a cathode side pole and an anode side pole. The substrate 16*b* has a rectangular shape, and the light emitting element 16*a* is disposed in the center part thereof.

The light source placement portion 14*a* is a rectangular pedestal corresponding to the shape of the substrate 16*b*. The light source placement portion 14*a* is provided with a light source positioning guide 14*c* comprising one set (eight in the illustrated case) of projections. Two projections are provided upright at each of the four corners of the light source placement portion 14*a*. One of the two projections comes into contact with the long side of the substrate 16*b* at the corner portion of the substrate 16*b*, and the other one comes into contact with the short side of the substrate 16*b* at the corner portion. In this manner, the light source positioning guide 14*c* receives the light source 16 at the light source placement portion 14*a* and positions the light source 16 at a fixed position.

For ease of understanding, FIG. 3 shows the light source positioning guide 14*c* of the placement member 14. In FIG. 3, illustration of other parts of the placement member 14 is omitted.

As shown in FIG. 3, the power supply attachment 30 is provided with an attachment main body 32, a pair of power supply terminals 34, a pair of first ribs 36, a pair of light source pressing pieces 38, and a pair of second ribs 40. The attachment main body 32, the first ribs 36, and the second ribs 40 are formed of an insulating material such as a resin. The power supply terminals 34 and the light source pressing pieces 38 are formed of a conductive material such as a metal.

The power supply attachment 30 is manufactured, for example, by insert molding of a metal member. In this case, the attachment main body 32, the first ribs 36, and the second ribs 40 are resin portions that are integrally formed. Portions of the metal member exposed outside the resin portions represent the power supply terminals 34. Corresponding to the cathode side pole and the anode side pole of the substrate 16*b* of the light source 16, a cathode side pole and an anode side pole also exist at the power supply terminals 34. Other portions of the metal member exposed outside the resin portions represent the light source pressing pieces 38.

The attachment main body 32 is provided with an attachment bottom surface 32*a*, which comes into contact with the placement member 14, and an attachment upper surface 32*b*, which faces the opposite side (that is, the same side as the light emitting element 16*a*). The attachment upper surface 32*b* is located at almost the same height as the light emitting element 16*a*.

The attachment main body 32 has an attachment opening 42 for receiving the light source placement portion 14*a*. The attachment opening 42 penetrates the attachment main body 32 from the attachment upper surface 32*b* to the attachment bottom surface 32*a*.

Further, the attachment main body 32 has, in the attachment opening 42, recessed portions 42*a* for receiving the light source positioning guide 14*c*. The recessed portions 42*a* are formed at the four corners of the attachment opening 42 in correspondence with the light source positioning guide 14*c*.

On the attachment bottom surface 32*a*, a connector portion 44 is provided. As shown in FIG. 2, a housing portion 14*d* is formed in the placement member 14, and when the power supply attachment 30 is attached to the placement member 14, the connector portion 44 is housed in the housing portion 14*d*. A connector (not shown) for supplying electric power to the light source 16 is connected to the connector portion 44.

The power supply terminal 34 on the cathode side extends inside the attachment main body 32 and is exposed inside the connector portion 44. The power supply terminal 34 on the anode side extends inside the attachment main body 32 and is exposed inside the connector portion 44. The power supply terminal 34 on the cathode side and the power supply terminal 34 on the anode side are insulated from each other by the resin portion forming the attachment main body 32. Respective exposed portions of the power supply terminals 34 toward the connector portion 44 serve as connection terminals for a connector that is installed in the connector portion 44. Therefore, when the connector is connected to the connector portion 44, the power supply attachment 30 allows for conduction from the connector portion 44 to the light source 16 through the power supply terminals 34.

The attachment main body 32 is provided with a first fixing portion 46 and a second fixing portion 48, which are fixed to the placement member 14. The first fixing portion 46 is located on one side with respect to the attachment opening 42, and the second fixing portion 48 is located on the other side with respect to the attachment opening 42. The first fixing portion 46 and the second fixing portion 48 each form a part of the attachment bottom surface 32*a*. The upper surface of the first fixing portion 46 and the upper surface of the second fixing portion 48 are somewhat lower than the attachment upper surface 32*b*. The connector portion 44 is provided in the first fixing portion 46.

As shown in FIG. 3, the first fixing portion 46 has a first positioning hole 46*a* and a first fixing screw hole 46*b*. The second fixing portion 48 has a second positioning hole 48*a* and a second fixing screw hole 48*b*. Since the first fixing portion 46 and the second fixing portion 48 are located opposite to each other with respect to the attachment opening 42, the first positioning hole 46*a* and the second positioning hole 48*a* are disposed so as to sandwich the light source 16. In the same way, the first fixing screw hole 46*b* and the second fixing screw hole 48*b* are disposed so as to sandwich the light source 16.

The first positioning hole 46*a* and the second positioning hole 48*a* are respectively engaged with a first positioning pin 14*e* and a second positioning pin 14*f* of the placement member 14. Thereby, the power supply attachment 30 is positioned on the placement member 14.

The first fixing screw 50 and the second fixing screw 52 shown in FIG. 2 are respectively inserted into the first fixing screw hole 46*b* and the second fixing screw hole 48*b*. The first fixing screw 50 and the second fixing screw 52 are attached to a first screw hole 14*g* and a second screw hole 14*h* of the placement member 14, respectively. In this way, the power supply attachment 30 is fixed to the placement member 14.

Further, the attachment main body 32 is provided with a pair of extending portions 54 extending along the attachment opening 42 from the first fixing portion 46 to the second fixing portion 48. The extending portions 54 form a part of the attachment bottom surface 32*a*. One extending portion 54 is located on one side with respect to the attachment opening 42, and the other extending portion 54 is located on the other side with respect to the attachment opening 42. Since the first fixing portion 46 is on one short side of the light source placement portion 14*a* and the second fixing portion 48 is on the other short side of the light source placement portion 14*a*, the pair of extending portions 54 extend along the long sides of the light source placement portion 14*a*.

In this manner, the attachment opening 42 is surrounded by the first fixing portion 46, the second fixing portion 48, and the pair of extending portions 54.

As shown in FIG. 3, the power supply terminals 34 extend from the attachment main body 32 to the attachment opening 42. Four power supply terminals 34 are provided in total, two on each side of the light source 16. Two power supply terminals 34 on one side protrude parallel to each other from the first fixing portion 46 side toward the center part of the attachment opening 42. The two power supply terminals 34 on the opposite side protrude parallel to each other from the second fixing portion 48 side toward the center part of the attachment opening 42.

When the power supply attachment 30 is attached to the placement member 14, the two power supply terminals 34 on the cathode side come into contact with the cathode side pole of the light source 16, and the two power supply terminals 34 on the anode side come into contact with the anode side pole of the light source 16. In this way, the power supply attachment 30 becomes conductive with the light source 16.

The first ribs 36 extend from the attachment main body 32 to the attachment opening 42. One first rib 36 is provided on each side of the light source 16. One of the first ribs 36 protrudes from the first fixing portion 46 side toward the center part of the attachment opening 42 in parallel with the power supply terminals 34, and the other first rib 36 protrudes from the second fixing portion 48 side toward the center part of the attachment opening 42 in parallel with the power supply terminals 34. The power supply terminals 34 and the first ribs 36 are disposed between the two recessed portions 42*a* adjacent to each other in the circumferential direction of the attachment opening 42 and located on the short side of the light source 16.

The first ribs 36 extend from the attachment main body 32 to the attachment opening 42 between the respective power supply terminals 34 and the respective recessed portions 42*a*. In this way, the first ribs 36 are disposed at places other than the recessed portions 42*a* so as to avoid interference with the light source positioning guide 14*c*.

Further, the first ribs 36 extend from the attachment main body 32 to the attachment opening 42 along the respective power supply terminals 34. In this manner, the first ribs 36 are disposed near the respective power supply terminals 34. Therefore, the first ribs 36 can effectively prevent interference of a misarranged light source 16 to the power supply terminals 34.

The projecting length of the first ribs 36 is shorter than the projecting length of the power supply terminals 34. Although the power supply terminals 34 extends beyond the edge of the light source 16 from the outside of the light source 16 in order to achieve conduction, the first ribs 36 do not reach the light source 16. When the light source 16 is properly placed on the light source placement portion 14*a*, a slight clearance is formed between a first rib distal end surface 36*a* and the substrate 16*b*.

The light source pressing pieces 38 extend from the attachment main body 32 to the attachment opening 42. A total of four light source pressing pieces 38 are provided, two on each side of the light source 16. The two light source pressing pieces 38 project in parallel with each other from one extending portion 54 to the attachment opening 42. These two light source pressing pieces 38 are disposed between two recessed portions 42*a* located on the long side of the light source 16.

When the power supply attachment 30 is attached to the placement member 14, the light source 16 is pressed against the light source placement portion 14*a* by the light source pressing pieces 38, and floating of the light source 16 is suppressed. As described above, the light source pressing pieces 38 are formed of a metal and functions as flat springs for pressing the light source 16.

The second ribs 40 extend from the attachment main body 32 to the attachment opening 42. One second rib 40 is provided on each side of the light source 16. Each of the second ribs 40 is disposed between two light source pressing pieces 38 and protrudes into the attachment opening 42 in parallel with the light source pressing pieces 38. In the same way as in the first ribs 36, the second ribs 40 are also disposed at places other than the recessed portions 42*a* so as to avoid interference with the light source positioning guide 14*c*.

Further, the second ribs 40 extend from the attachment main body 32 to the attachment opening 42 along the respective light source pressing pieces 38. Since the second ribs 40 are disposed near the light source pressing pieces 38, the second ribs 40 can effectively suppress interference of a misarranged light source 16 to the light source pressing pieces 38.

The projecting length of the second ribs 40 is shorter than the projecting length of the light source pressing pieces 38. Although the light source pressing pieces 38 extend beyond the edge of the light source 16 in order to press the light source 16, the second ribs 40 do not reach the light source 16. When the light source 16 is properly placed on the light source placement portion 14*a*, a slight clearance is formed between a second rib distal end surface 40*a* and the substrate 16*b*.

In this manner, the attachment opening 42 is provided with the power supply terminals 34 and the light source pressing pieces 38 such that the power supply terminals 34 and the light source pressing pieces 38 surround the light source 16. Further, the first ribs 36 and the second ribs 40 are provided so as to fill in spaces excluding the power supply terminals 34, the light source pressing pieces 38, and the recessed portions 42*a* between the attachment opening 42 and the light source 16. The first ribs 36 and the second ribs 40 are disposed so as to respectively correspond to the four sides of the substrate 16*b* of the light source 16.

Figure 4:
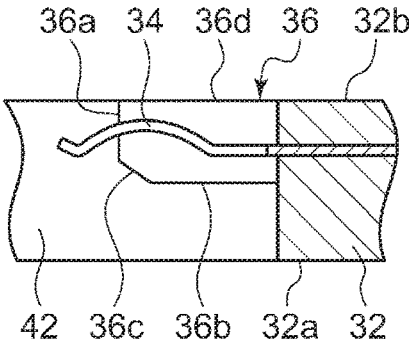
FIG. 4 is a cross-sectional view sectioned along line A-A of a power supply attachment shown in FIG. 3.

FIG. 4 is a cross-sectional view sectioned along line A-A of the power supply attachment 30 shown in FIG. 3. FIG. 4 schematically shows a power supply terminal 34, a first rib 36, and the periphery thereof. As described above, the power supply terminal 34 and the first rib 36 protrude from the attachment main body 32 to the attachment opening 42. The power supply terminal 34 is gently curved convexly toward the attachment upper surface 32*b* side so as to secure an appropriate flexural contact load when coming into contact with the light source 16. The distal end of the power supply terminal 34 is directed obliquely upward.

In addition to the first rib distal end surface 36*a*, the first rib 36 includes a first rib bottom surface 36*b* and a first rib upper surface 36*d*. The first rib bottom surface 36*b* becomes closer to the attachment bottom surface 32*a* than the power supply terminal 34. The first rib upper surface 36*d* is flush with the attachment upper surface 32*b*. The power supply terminal 34 is located between the first rib upper surface 36*d* and the first rib bottom surface 36*b*.

The first rib bottom surface 36*b* is provided with a first rib distal end inclined surface 36*c*. The first rib distal end inclined surface 36*c* is inclined so as to connect the first rib bottom surface 36*b* to the first rib distal end surface 36*a*. In the illustrated case, the first rib distal end inclined surface 36*c* is a flat inclined surface. However, the first rib distal end inclined surface 36*c* is not limited thereto and may be a curved surface. The first rib distal end surface 36*a* connects the first rib distal end inclined surface 36*c* to the first rib upper surface 36*d* and is perpendicular to the first rib upper surface 36*d*.

Figure 5:
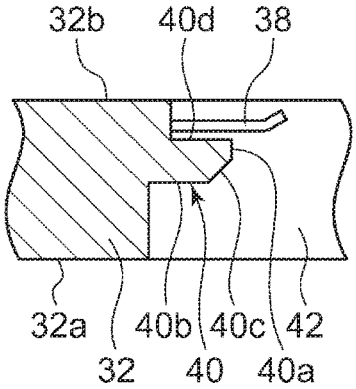
FIG. 5 is a cross-sectional view sectioned along line B-B of the power supply attachment shown in FIG. 3.

FIG. 5 is a cross-sectional view sectioned along line B-B of the power supply attachment 30 shown in FIG. 3. FIG. 5 schematically shows a light source pressing piece 38, a second rib 40, and the periphery thereof. As described above, the light source pressing piece 38 and the second rib 40 protrude from the attachment main body 32 to the attachment opening 42. The light source pressing piece 38 extends in a straight line, and the distal end thereof is directed obliquely upward.

In addition to the second rib distal end surface 40*a*, the second rib 40 is provided with a second rib bottom surface 40*b* and a second rib upper surface 40*d*. The second rib bottom surface 40*b* becomes closer to the attachment bottom surface 32*a* than the light source pressing piece 38. The second rib upper surface 40*d* also becomes closer to the attachment bottom surface 32*a* compared to the light source pressing piece 38. That is, the light source pressing piece 38 is located between the second rib 40 and the attachment upper surface 32*b*.

The second rib bottom surface 40*b* is provided with a second rib distal end inclined surface 40*c*. The second rib distal end inclined surface 40*c* is inclined so as to connect the second rib bottom surface 40*b* to the second rib distal end surface 40*a*. In the illustrated case, the second rib distal end inclined surface 40*c* is a flat inclined surface. However, the second rib distal end inclined surface 40*c* is not limited thereto and may be a curved surface. The second rib distal end surface 40*a* connects the second rib distal end inclined surface 40*c* to the second rib upper surface 40*d* and is perpendicular to the second rib upper surface 40*d*.

Figure 6:
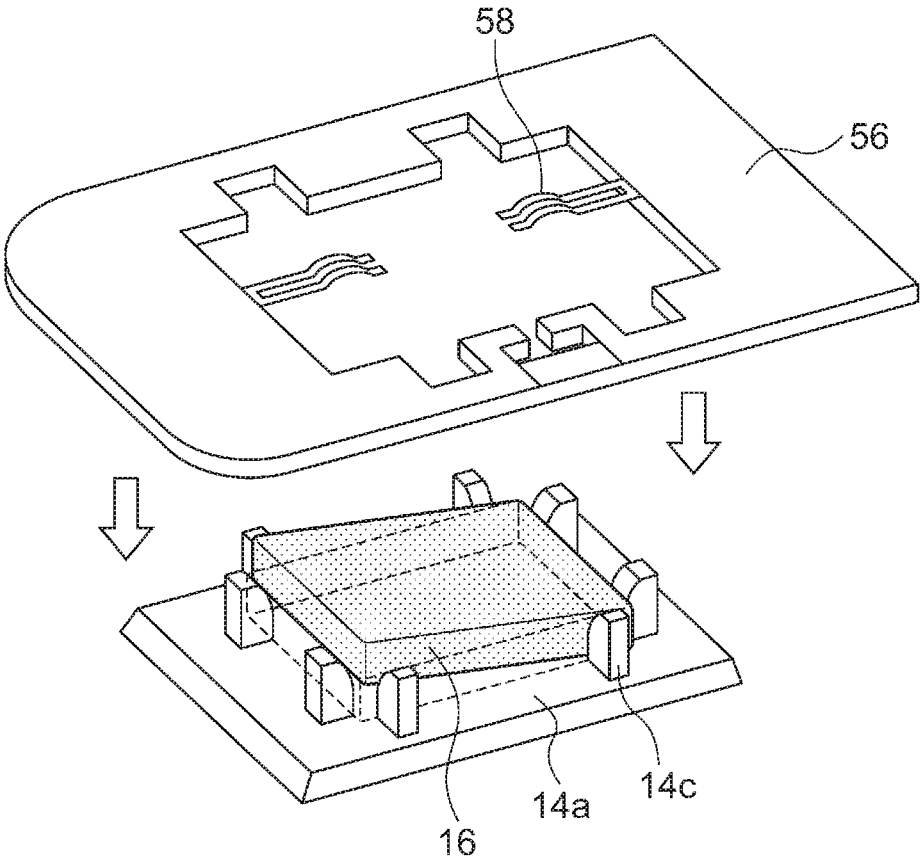
FIG. 6 is a diagram illustrating the arrangement of the light source.

In the assembly process, it is desired that the light source 16 be accurately placed on the light source placement portion 14*a*. However, the light source 16 can be erroneously placed in an incorrect place. FIG. 6 exemplifies misarrangement of the light source 16 on the light source placement portion 14*a*. Correctly, as indicated by a broken line, the light source 16 should be surrounded by the light source positioning guide 14*c* and placed on the light source placement portion 14*a*. However, as illustrated, the light source 16 possibly becomes slightly off the correct location and sit on some light source positioning guides 14*c*.

If a conventional type (i.e., no rib) attachment 56 is assembled to the light source 16 misarranged as described, the attachment 56 interferes with the light source 16, and the attachment 56 can be deformed. For example, metal parts such as power supply terminals 58 and pressing pieces are easily deformed. There is a possibility that the attachment 56 may be incorrectly assembled while being in such a deformed state.

Figure 7:
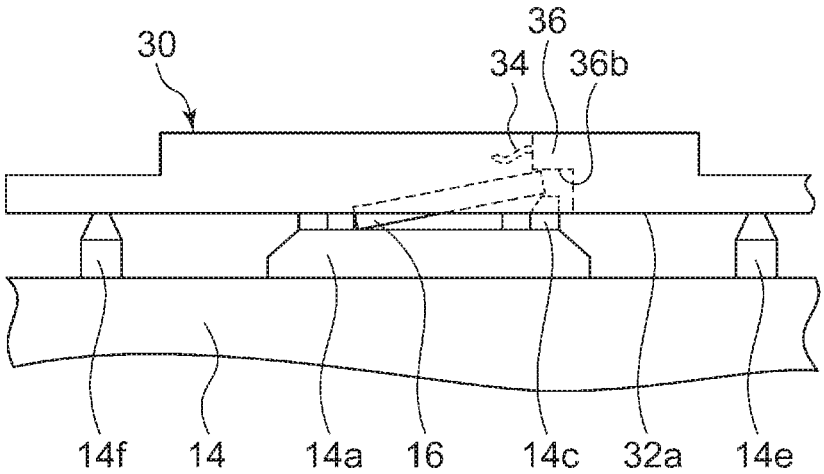
FIG. 7 is a diagram illustrating the arrangement of the light source.

On the other hand, the power supply attachment 30 according to the first embodiment is provided with the first ribs 36, and the first rib bottom surfaces 36*b* become closer to the attachment bottom surface 32*a* than the respective power supply terminals 34. Therefore, even when the light source 16 is located in a wrong place, when the power supply attachment 30 is attached to the placement member 14, the first rib bottom surface 36*b* first hits the light source 16 as shown in FIG. 7.

If the positional displacement of the light source 16 from the light source placement portion 14*a* is large, the light source 16 is sandwiched between the light source positioning guide 14*c* and the first rib 36, and the power supply attachment 30 is lifted from the placement member 14. Therefore, the power supply attachment 30 cannot be directly assembled to the misarranged light source 16. This prevents erroneous assembly of the power supply attachment 30.

If the positional displacement of the light source 16 from the light source placement portion 14*a* is small, the first rib 36 can push out the light source 16 sitting on the light source positioning guide 14*c* to the correct place (that is, the light source placement portion 14*a*). In this manner, the first rib 36 can also play a role of assisting the positioning of the light source 16.

When the substrate 16*b* of the light source 16 bumps into the first rib distal end inclined surface 36*c*, the force acting on the substrate 16*b* from the first rib distal end inclined surface 36*c* has a lateral direction component determined according to the angle of the inclined surface. The term "lateral direction" refers to a direction parallel to the surface of the light source placement portion 14*a*. Since a lateral direction force acts on the substrate 16*b* from the first rib distal end inclined surface 36*c*, the light source 16 sitting on the light source positioning guide 14*c* is easily pushed out in the lateral direction. Therefore, the first rib distal end inclined surface 36*c* is effective for assisting the positioning of the light source 16.

Just like the first ribs 36, the second ribs 40 also serve to prevent erroneous assembly of the power supply attachment 30. Further, the second rib distal end inclined surface 40*c* can assist in positioning the light source 16 to the light source placement portion 14*a*.

The power supply attachment 30 according to the first embodiment further has some advantageous features useful for accurate assembly.

As shown in FIG. 3, the distance D1 between the first positioning hole 46*a* and the second positioning hole 48*a* is different from the distance D2 between the first fixing screw hole 46*b* and the second fixing screw hole 48*b*. In the case of FIG. 3, the distance D1 is shorter than the distance D2. Conversely, the distance D2 may be shorter than the distance D1. The distances D1 and D2 are the distances between the respective centers of the holes. Such a difference in distance helps prevent confusion between the positioning holes and the fixing screw holes in the assembly process. Only when the first positioning pin 14*e* and the second positioning pin 14*f* are properly fitted into the first positioning hole 46*a* and the second positioning hole 48*a*, respectively, the first fixing screw hole 46*b* coincides with the first screw hole 14*g* of the placement member 14, and the second fixing screw hole 48*b* coincides with the second screw hole 14*h* of the placement member 14. For example, if the first positioning pin 14*e* is mistakenly inserted into the first fixing screw hole 46*b*, the screw holes do not coincide with each other, and the power supply attachment 30 cannot be attached to the placement member 14.

Further, as described above, the extending portions 54 form a part of the attachment bottom surface 32*a*, and the four sides of the light source placement portion 14*a* are surrounded by the attachment bottom surface 32*a*. In this manner, the attachment main body 32 is formed to be thick. Due to this thickness, even when the power supply attachment 30 is assembled at an incorrect position, screwing cannot be performed.

When the light source 16 is placed on the light source placement portion 14*a*, the distal end of the light source positioning guide 14*c* may be higher than the height of the substrate 16*b*. In this way, it is difficult for the light source 16 to sit on the light source positioning guide 14*c*.

The structure of the power supply attachment 30 and the arrangement of the power supply terminals 34, the first ribs 36, and the like are not limited to the above-described specific examples in the first embodiment, and various modifications may be adopted. Several embodiments are exemplified below.

(Second Embodiment)

Figure 8:
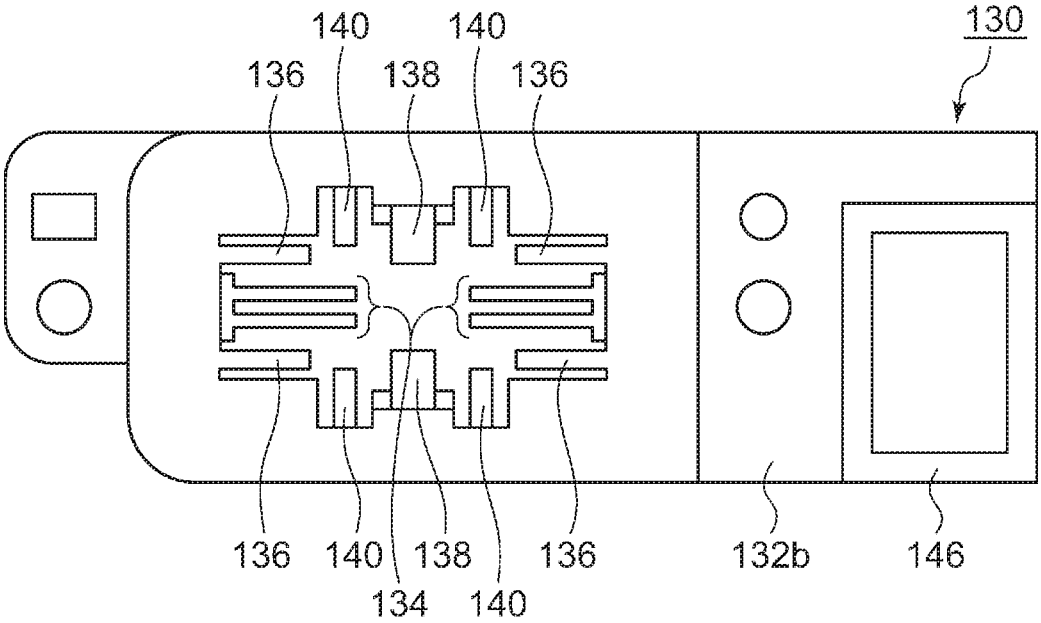
FIG. 8 is a schematic top view of the power supply attachment according to a second embodiment.

FIG. 8 is a schematic top view of a power supply attachment 130 according to a second embodiment. As shown, the power supply attachment 130 is provided with a connector portion 146. The connector portion 146 is provided on an attachment upper surface 132*b*. In this way, there is no need to provide a notch portion for housing the connector portion 146 in the placement member (for example, a heat sink). This contributes to the miniaturization of the heat sink and the improvement of the heat dissipation thereof. Further, since the connector portion 146 is on the attachment upper surface 132*b*, workability for connector connection is improved.

In the same way as in the first embodiment, the power supply attachment 130 is provided with first ribs 136 and second ribs 140. Two power supply terminals 134 are provided on each side of the power supply attachment 130. The power supply terminals 134 are disposed between two first ribs 136. Further, light source pressing pieces 138 are provided, one on each side of the power supply attachment 130. The light source pressing pieces 138 extend in a direction perpendicular to the power supply terminal 134. Each light source pressing piece 138 is disposed between two second ribs 140.

Unlike the first embodiment, the power supply attachment 130 does not have a recessed portion for a light source positioning guide. Further, the number of the light source pressing pieces 138 is small. In this way, the power supply attachment 130 is also downsized.

(Third Embodiment)

Figure 9:
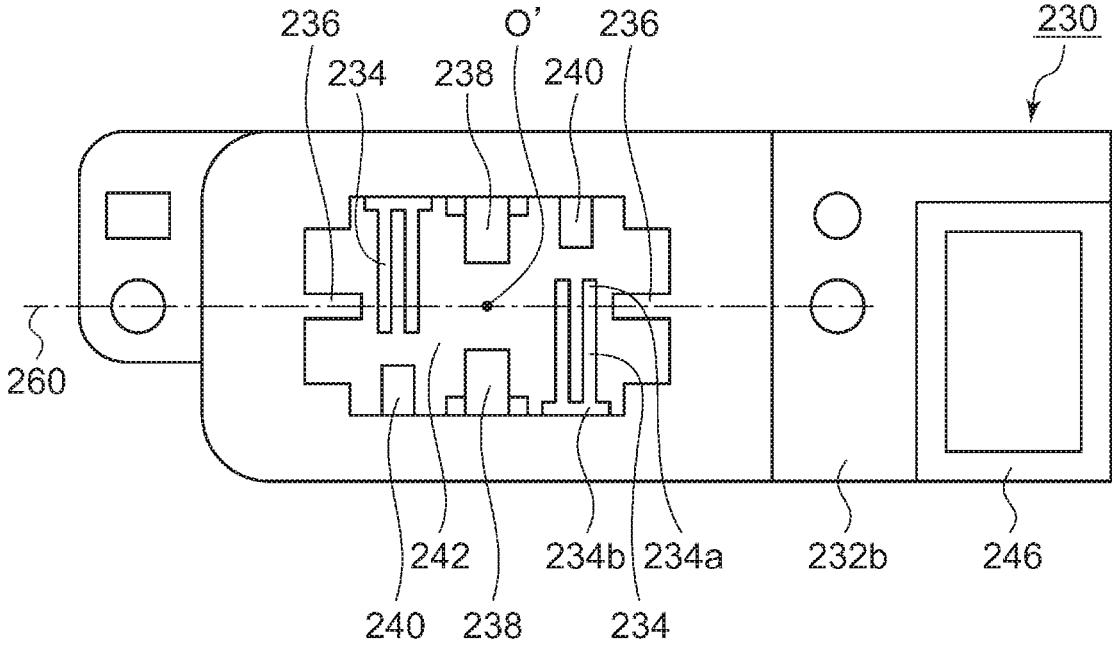
FIG. 9 is a schematic top view of the power supply attachment according to a third embodiment.

FIG. 9 is a schematic top view of a power supply attachment 230 according to a third embodiment. In the same manner as in the second embodiment, a connector portion 246 is provided on an attachment upper surface 232*b*.

Further, power supply terminals 234 have a power supply terminal distal end 234*a* and a power supply terminal base portion 234*b*. The power supply terminals 234 are disposed adjacent to respective light source pressing pieces 238 in the circumferential direction of an attachment opening 242. An intermediate line 260, which bisects the attachment opening 242 through an optical axis O' of the light source, is taken into consideration. The intermediate line 260 passes through the midpoint between the two light source pressing pieces 238. At this time, the power supply terminal distal end 234*a* is located on one side with respect to the intermediate line 260, and the power supply terminal base portion 234*b* is located on the other side with respect to the intermediate line 260. The power supply terminals 234 extend beyond the intermediate line 260 from the respective power supply terminal base portions 234*b* to the respective power supply terminal distal ends 234*a*. This allows the power supply terminals 234, which are formed in an elongated form so as to provide desired deflection characteristics, to be housed in the attachment opening 242 having a small area. Therefore, the compact power supply attachment 230 can be provided.

Similarly, the power supply attachment 230 is provided with first ribs 236 and second ribs 240. The first ribs 236 are adjacent to the respective power supply terminals 234 in the circumferential direction of the attachment opening 242, and the second ribs 240 are adjacent to the respective light source pressing pieces 238 in the circumferential direction of the attachment opening 242. The second ribs 240 are located on the same long side as the power supply terminals 234 and the light source pressing pieces 238. Unlike the second ribs 240, the first ribs 236 are located on the short side of the attachment opening 242.

(Fourth Embodiment)

Figure 10:
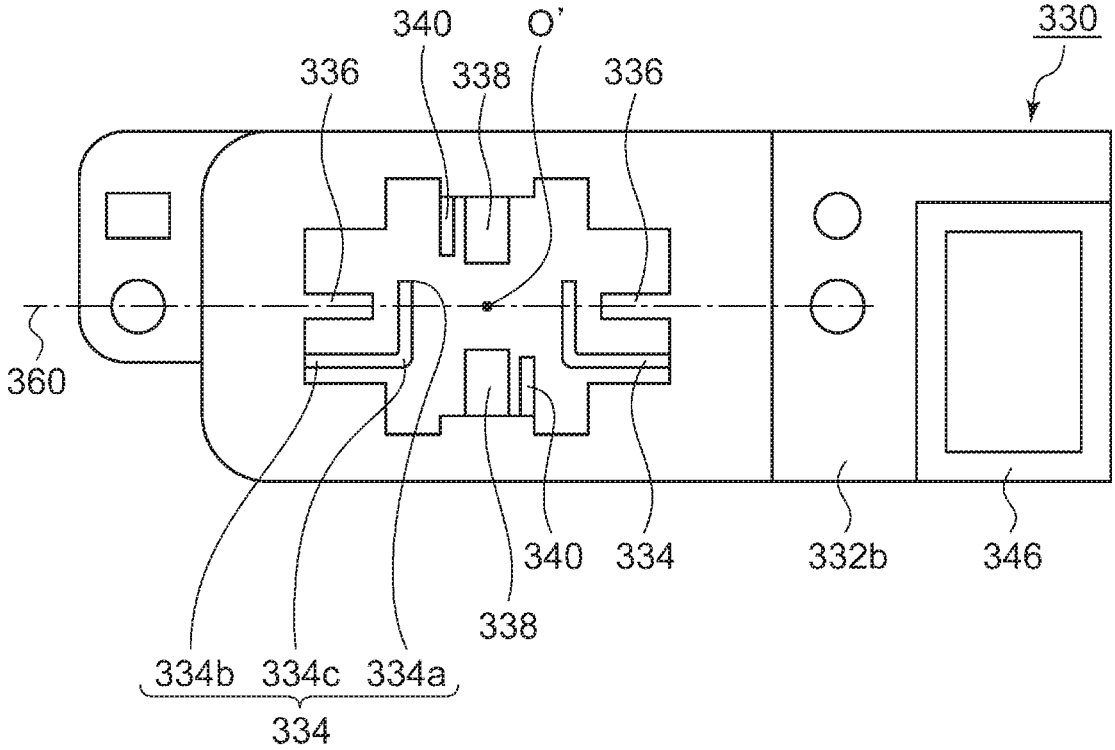
FIG. 10 is a schematic top view of the power supply attachment according to a fourth embodiment.

FIG. 10 is a schematic top view of a power supply attachment 330 according to a fourth embodiment. In the same manner as in the second embodiment, a connector portion 346 is provided on an attachment upper surface 332*b*. In the same manner as in the above embodiments, the power supply attachment 330 is provided with first ribs 336 and second ribs 340.

Power supply terminals 334 are provided with a power supply terminal distal end 334*a* located on one side with respect to an intermediate line 360, which bisects an attachment opening 342 through an optical axis O' of the light source, and a power supply terminal base portion 334*b* located on the other side with respect to the intermediate line 360. The intermediate line 360 passes through the midpoint between the two light source pressing pieces 338. The power supply terminals 334 extend beyond the intermediate line 360 from the respective power supply terminal base portions 334*b* to the respective power supply terminal distal ends 334*a*. Further, the power supply terminals 334 are provided with a bent portion 334*c* between the power supply terminal base portion 334*b* and the power supply terminal distal end 334*a*. The power supply terminals 334 are bent by 90 degrees at the respective bent portions 334*c*. This also allows for both the ensuring of the deflection characteristics of the power supply terminals 334 and the miniaturization of the power supply attachment 330.

(Fifth Embodiment)

Figure 11:
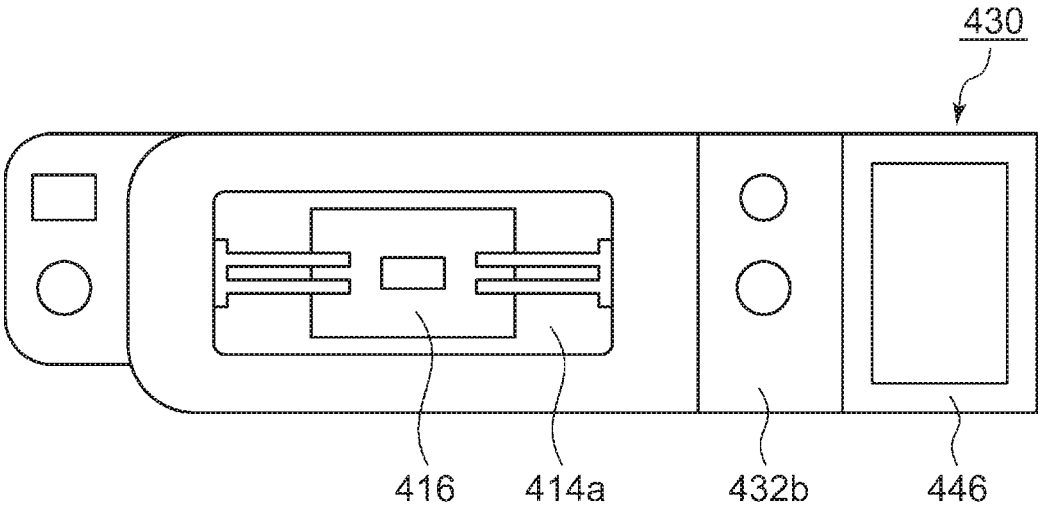
FIG. 11 is a schematic top view of the power supply attachment according to a fifth embodiment.

FIG. 11 is a schematic top view of a power supply attachment 430 according to a fifth embodiment. In the same manner as in the second embodiment, a connector portion 446 is provided on an attachment upper surface 432*b*.

The power supply attachment 430 does not have a pressing piece for pressing the light source. This allows the power supply attachment 430 to be downsized. In this case, a light source 416 may be fixed to a light source placement portion 414*a* through adhesion. Therefore, no positioning guide is provided on the light source placement portion 414*a*.

Further, since the power supply attachment 430 does not have a first rib or a second rib, further miniaturization is possible. The power supply attachment 430 may have a first rib and a second rib as in the same way as in the embodiments described above.

(Sixth Embodiment)

Figure 12:
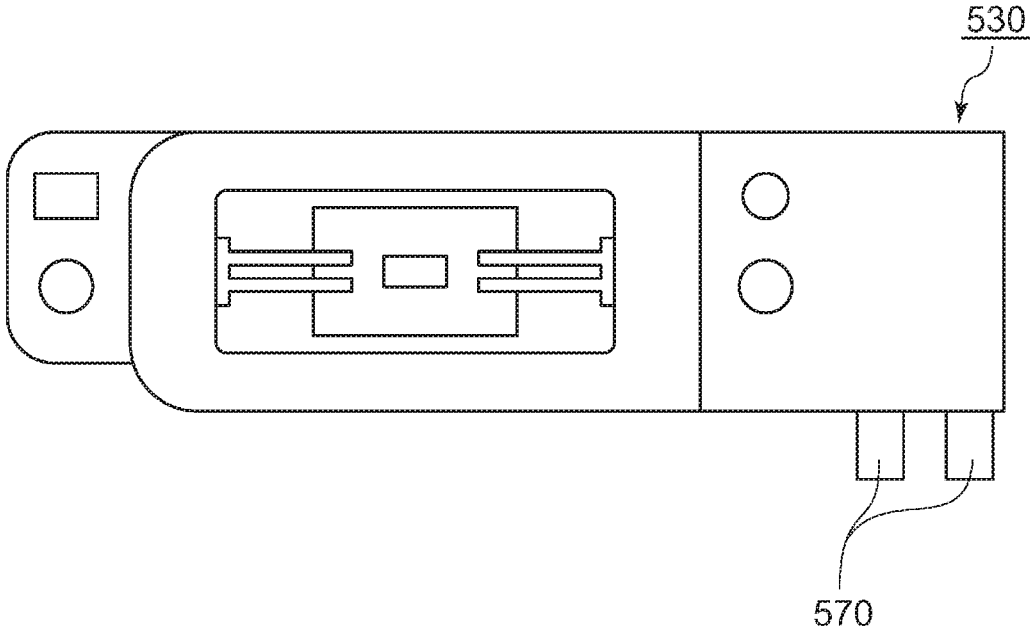
FIG. 12 is a schematic top view of the power supply attachment according to a sixth embodiment.

FIG. 12 is a schematic top view of a power supply attachment 530 according to a sixth embodiment. In each of the above-stated embodiments, a connector portion is provided on a power supply attachment. However, this is non-limiting. The power supply attachment 530 may provide electrical connection to the light source by connectorless connection such as pressure joining that does not use a connector. Thus, the power supply attachment 530 is provided with pressure joining terminal portions 570 instead of a connector portion. In this way, since there is no connector portion, the power supply attachment 530 is downsized. Further, the configuration of the power supply attachment 530 is simplified, which is also useful for reducing the cost of the power supply attachment 530.

Further, since the power supply attachment 530 does not have a first rib or a second rib, further miniaturization is possible. The power supply attachment 530 may have a first rib and a second rib as in the same way as in the embodiments described above.

The connectorless connection is not limited to pressure joining. For example, instead of the pressure joining terminal portions 570, a pressure welding terminal portion or a solder fixing portion (for example, a solder pot or an eyelet) may be provided on the power supply attachment. Alternatively, a connection cord may be formed integrally with the power supply attachment.

The present invention is not limited to the above-mentioned embodiments, and various modifications, such as a design change, may be added thereto on the basis of knowledge of those skilled in the art. It should be understood that any embodiment to which one or more of the modifications are added is also included in the scope of the invention.

In the power supply attachments according to the second embodiment through the fourth embodiment, first ribs and second ribs are provided. However, in these embodiments, first ribs and second ribs are not essential. First ribs and second ribs may be omitted from the respective power supply attachments according to the second embodiment through the fourth embodiment.

What is claimed is:

1. A power supply attachment for providing electrical connection to a light source and fixing the light source to a light source placement portion on a placement member, comprising:

an attachment main body that is provided with an attachment bottom surface that comes into contact with the placement member, and has an attachment opening for receiving the light source placement portion;

a power supply terminal that extends from the attachment main body to the attachment opening; and a first rib that extends from the attachment main body to the attachment opening, wherein the first rib is provided with:

a first rib distal end surface, a first rib bottom surface that becomes closer to the attachment bottom surface than the power supply terminal, and a first rib distal end inclined surface that connects the first rib bottom surface to the first rib distal end surface, the first rib distal end inclined surface inclined relative to both of the first rib bottom surface and the first rib distal end surface.

2. The power supply attachment according to claim 1, wherein the first rib distal end inclined surface is a curved surface.

3. The power supply attachment according to claim 1, wherein the attachment main body has, in the attachment opening, a recessed portion for receiving a light source positioning guide of the light source placement portion, and wherein the first rib extends from the attachment main body to the attachment opening between the power supply terminal and the recessed portion.

4. The power supply attachment according to claim 1, wherein the first rib extends from the attachment main body to the attachment opening along the power supply terminal.

5. The power supply attachment according to claim 1, further comprising:

a light source pressing piece that extends from the attachment main body to the attachment opening; and a second rib that extends from the attachment main body to the attachment opening along the light source pressing piece, wherein the second rib is provided with a second rib bottom surface that becomes closer to the attachment bottom surface than the light source pressing piece.

6. The power supply attachment according to claim 1, wherein a connector portion is provided on an attachment upper surface.

7. The power supply attachment according to claim 1, wherein the power supply terminal is provided with:

a power supply terminal distal end located on one side with respect to an intermediate line that bisects the attachment opening through an optical axis of the light source and a power supply terminal base portion located on the other side with respect to the intermediate line, the power supply terminal extends across the intermediate line from the power supply terminal base portion to the power supply terminal distal end.

8. An automotive lamp comprising:

a light source;

a placement member that is provided with a light source placement portion on which the light source is placed; and a power supply attachment according to claim 1 for providing electrical connection to the light source and fixing the light source to the light source placement portion.

* * * * *